US010088129B2

(12) United States Patent
Levin

(10) Patent No.: US 10,088,129 B2
(45) Date of Patent: Oct. 2, 2018

(54) DISCRIMINATING RADIAL ILLUMINATOR

(71) Applicant: Laurence J. Levin, Milwaukee, WI (US)

(72) Inventor: Laurence J. Levin, Milwaukee, WI (US)

( * ) Notice: Subject to any disclaimer, the term of this patent is extended or adjusted under 35 U.S.C. 154(b) by 175 days.

(21) Appl. No.: 14/751,471

(22) Filed: Jun. 26, 2015

(65) Prior Publication Data

US 2016/0377264 A1 Dec. 29, 2016

(51) Int. Cl.
*F21V 21/30* (2006.01)
*F21V 14/02* (2006.01)

(52) U.S. Cl.
CPC ..... *F21V 14/02* (2013.01)

(58) Field of Classification Search
CPC ..... F21V 14/02
USPC ..... 362/35
See application file for complete search history.

(56) References Cited

U.S. PATENT DOCUMENTS

| | | | | |
|---|---|---|---|---|
| 1,961,116 | A | 5/1934 | Van Braam Van Vloten | |
| 4,054,791 | A | 10/1977 | DuShane | |
| 4,153,926 | A | 5/1979 | Hurt | |
| 4,701,743 | A | 10/1987 | Pearlman et al. | |
| 5,126,923 | A | 6/1992 | Hall, II | |
| 5,517,388 | A | 5/1996 | Hutchisson | |
| 5,607,217 | A | 3/1997 | Hobbs, II | |
| 5,673,989 | A | 10/1997 | Gohl et al. | |
| 5,915,823 | A | 6/1999 | Simon | |
| 5,954,416 | A | 9/1999 | Peterson | |
| 5,988,838 | A | 11/1999 | Rudenberg | |
| 6,183,120 | B1 | 2/2001 | Simon | |
| 6,250,768 | B1 * | 6/2001 | Hill | A63H 33/30 362/253 |
| 6,352,357 | B1 | 3/2002 | Woolard | |
| 6,379,027 | B1 | 4/2002 | Haugaard et al. | |
| 6,508,579 | B1 | 1/2003 | Ruud et al. | |
| 6,547,410 | B1 | 4/2003 | Pederson | |
| 6,705,745 | B1 | 3/2004 | Pederson | |
| 6,926,426 | B2 | 8/2005 | Currie et al. | |
| 6,955,447 | B2 | 10/2005 | Lui | |
| 7,114,821 | B2 | 10/2006 | Currie et al. | |
| 7,963,683 | B2 | 6/2011 | Czajkowski et al. | |
| 8,182,122 | B2 * | 5/2012 | Chiu | B60Q 1/245 362/272 |
| 8,226,265 | B2 | 7/2012 | Czajkowski et al. | |
| 8,742,686 | B2 | 6/2014 | Zampini, II et al. | |
| 2004/0037064 | A1 * | 2/2004 | Johnson | F21S 8/003 362/35 |
| 2008/0094819 | A1 * | 4/2008 | Vaish | F21S 10/06 362/35 |
| 2010/0259945 | A1 * | 10/2010 | Chiu | B60Q 1/245 362/428 |
| 2011/0292672 | A1 * | 12/2011 | Yang | F21S 10/06 362/523 |
| 2012/0230039 | A1 * | 9/2012 | Hansen Ellevang | F21V 11/18 362/351 |

(Continued)

*Primary Examiner* — Tuyen K Vo

(57) ABSTRACT

Disclosed is a Discriminating Radial Illuminator (DRI), which is a portable illumination and obscuration system offering unique advantages over conventional methods of illumination. Exemplary uses include: Tactical illumination and obscuration for military, law enforcement and private security; special effects lighting for the entertainment industry; architectural and commercial lighting, both interior and exterior.

18 Claims, 6 Drawing Sheets

(56) References Cited

U.S. PATENT DOCUMENTS

| | | | | |
|---|---|---|---|---|
| 2013/0276315 | A1* | 10/2013 | Kahle | G01C 15/06 33/228 |
| 2013/0294080 | A1* | 11/2013 | Hansen | F21S 10/00 362/271 |
| 2016/0109079 | A1* | 4/2016 | McKinley | F02B 63/047 362/89 |
| 2016/0258601 | A1* | 9/2016 | Gowanlock | F21L 13/00 |
| 2017/0166067 | A1* | 6/2017 | Panopoulos | B60L 11/182 |

* cited by examiner

DISCRIMINATING RADIAL ILLUMINATOR

BACKGROUND OF THE INVENTION

The present invention relates to lighting systems that are deployed in high threat environments, such as active combat zones, enhanced security areas, and situations requiring surveillance or crowd control. Relative lighting systems are also used, as general and specific lighting for theatrical and concert productions, sporting events, trade shows, and can be adjunct, to entertainments such as dancing. Commercial and architectural lighting systems utilized for signs and structures also relate to the present invention.

Lighting can be an important factor in the management of high threat areas. Arrays of floodlights are used not only to illuminate an object, structure, or perimeter, but can be positioned specifically to blind and disorientate hostile personnel and optical equipment. Military, law enforcement, and security forces are trained to use such lights for both purposes. Likewise, spotlights, exploited for their focus, range and intensity to track and identify targets, can also be used, to blind and disorientate. Nearly ubiquitous in these applications, spotlights are often mounted on vehicles and buildings, but man-portable models of extraordinary power are available to tactical personnel. These various methods of illumination and lighting sightlines are considered in the design and operation of prisons, checkpoints, and other secure facilities. Many non-lethal weapon and deterrence systems also utilize the effects of visible light to temporarily disable personnel and optical equipment.

The entertainment industry relies upon a plethora of specialized lighting fixtures and systems, not only for the primary illumination of a stage, field, or arena, but also as special effects. These components are often designed to be portable, rather than part of a permanent installation. Incandescent par cans, spotlights, strobes, lasers, and intelligent moving lights are a few of the types of fixtures commonly used. Complexity, precision, and the exact duplication of a performance are made possible by wired and wireless computerized control. These systems are commonly used to visually enhance trade shows, sporting events, and dance floors.

Architectural and commercial lighting uses some fixtures and control systems similar to those found in entertainment lighting, one general design difference being the emphasis on long-term reliability and weatherproofing, rather than portability. These systems offer central control of interior and exterior lighting, and can be programmed to execute various lighting scenes on a schedule.

SUMMARY OF THE INVENTION

Disclosed is a Discriminating Radial Illuminator (DRI), which is a portable illumination and obscuration system offering unique advantages over conventional methods of illumination. Exemplary uses include: Tactical illumination and obscuration for military, law enforcement and private security; special effects lighting for the entertainment industry; architectural and commercial lighting, both interior and exterior.

A DRI comprises one or more light sources focused upon a mechanically rotated reflector, which directs the light output onto a horizontal plane. A high frequency of reflector rotation thus combines the focus and range of a tightly collimated spotlight beam with the wash and coverage of a floodlight. A single DRI unit can provide a full 360 degrees of perimeter illumination while offering greater range and a larger area of coverage as compared to a floodlight of equal power. A programmable control system enables its operator to tailor the behavior of the DRI by selectively opening and closing the illumination. (The terms "open" and "close" are used here to denote only whether or not the DRI is projecting light, and are not meant to be suggestive of the method by which this effect is achieved.) By cycling the illumination open and closed at the same points during each rotation of the reflector, the appearance of a steady beam of light is produced. This beam of light can be widened to a full 360 degree field of coverage, or reduced to a narrow spotlight, simply by altering the duration of the open cycle. In this manner, single or multiple beams or sectors of illumination can be generated, all radiating from a single unit. The rotating optics are capable of executing rapid adjustments to the beam's vertical angle per rotation, allowing it to sweep targets located at differing elevations relative to the DRI. Furthermore, the rotating optics can make fine adjustments to the vertical spread of the beam per rotation. These basic functions can be recorded, and executed as presets, thereby allowing the precise illumination of static targets at various ranges and elevations. Additionally, a "lock, and dwell" function offers stationary (non-rotational) positioning of the light beam at any radial and vertical angle. The targeting of multiple lock points having various dwell durations can be programmed to run in a repeating sequence.

A DRI is capable of simultaneously operating under at least two different protocols. By connecting a dedicated hand-held master controller or a computer, operational programs can be input and executed onsite. Concurrently, the DRI can track and receive commands in real time via radio frequency (RF). Upon activating a personal radio frequency controller/transmitter unit (hereafter referred to as a "transmitter"), an operative moving within a DRI's range can be painted with, illumination as the DRI tracks the transmitter's location—the "follow spot" effect. Additionally, the operative can utilize the transmitter itself to program new patterns simply by signaling the DRI to begin recording the operator's movement through the area. Each DRI unit is able to track multiple transmitters.

Operation can involve single or multiple DRI units. In a preferred embodiment, the deployment of three or more units insures full illumination coverage, as well as facilitating RF triangulation. In any given scenario, any number of units could be used, running various preset programs, and responding to transmitter signals on differing or identical frequencies.

Many of the tactical functions of the DRI are based upon the differential illumination it generates. Observers experience this illumination as either a benefit or an impediment, and could thus be put into one of two categories, labeled "included" observers and "excluded" observers. The prominence of these advantages and disadvantages is dependent upon the techniques of DRI emplacement and site preparation, as well as ambient light levels and other environmental variables.

DRIs are capable of being utilized specifically to visually impair excluded observers both by the sheer intensity of the light and by variable strobing effects, which can be tuned by the operator. Due to the radial coverage of the DRIs, this illumination can be difficult to avoid. Excluded observers experience this illumination as a wash of floodlight combined with multiple high-intensity spotlights aimed directly at their locations.

Usage of a transmitter also enables the phenomenon of "negative illumination," whereby the transmitter's operator is painted with "dark," in contrast to the illumination covering the rest of the area. This provides the operator(s) with obscurity, or even invisibility. Operators using the transmitter function in this manner cannot be "blinded" by the DRIs, for the illumination is always closed as it sweeps across their position. The illumination thus appears to the operator(s) and other included observers as a smooth field of coverage with no evident source, without the deep shadows and harsh highlights that often accompany the single point illumination generated by a spotlight or floodlight.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Figure 1:
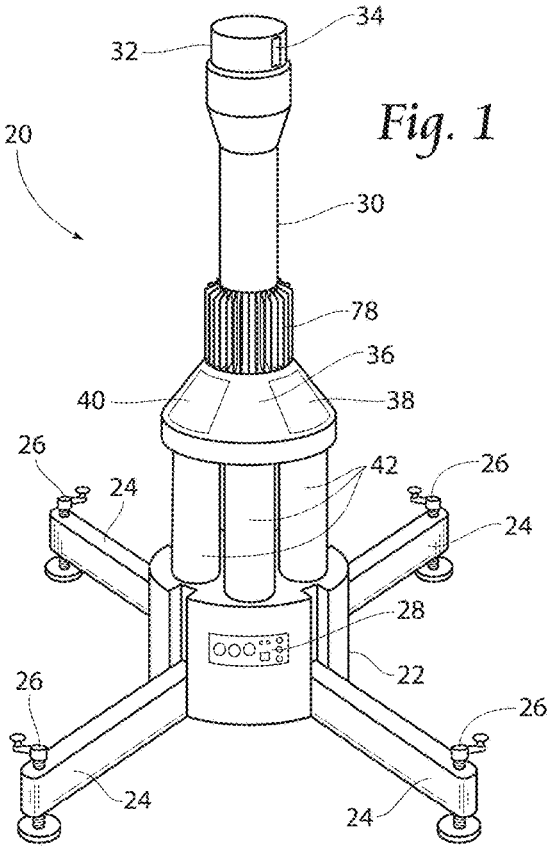
FIG. 1 is a perspective view of a DRI tower of the present invention.

Referring now to FIG. 1, a perspective view of DRI tower 20 of the present invention is shown. In a preferred embodiment, tower 20 is a man-portable unit, the vertical dimension of which is intended to place the origin of the projected illumination just above the head, of an average adult. A single tower 20 could be used, but most circumstances will call for multiple tower 20 emplacement; three being an ideal minimum number, to insure full illumination, and to facilitate RF triangulation. Any greater number of towers 20 could be deployed, dependent upon the circumstances. Base 22 mounts four folding outriggers 24. Outriggers 24 are lockable in an "up" position for storage and transport, or "down", in which instance four screw jacks 26 can be used to manually stabilize and level tower 20. Base 22 provides weatherproof connections 28 to route external electrical power and data transmission lines in, out, and through tower 20. Central column 30 is attached to base 22 and supports rotary head 32. Output illumination exits rotary head 32 via aperture 34. Surrounding the midsection of central column 30 is skirt 36, featuring transmitter recharging station access panel 38, and master controller access panel 40. Installed and locked into positions between skirt 36 and base 22 are four light engines 42. Light engines 42 provide the source(s) of illumination, and are designed to be quickly interchanged with one another as required. An alternate embodiment relies upon a single light source located within central column 30, and thus eliminates the need for four light engines 42. However, the four light engine 42 configuration offers greater operational flexibility and reliability, and therefore is a preferred embodiment.

Figure 2:
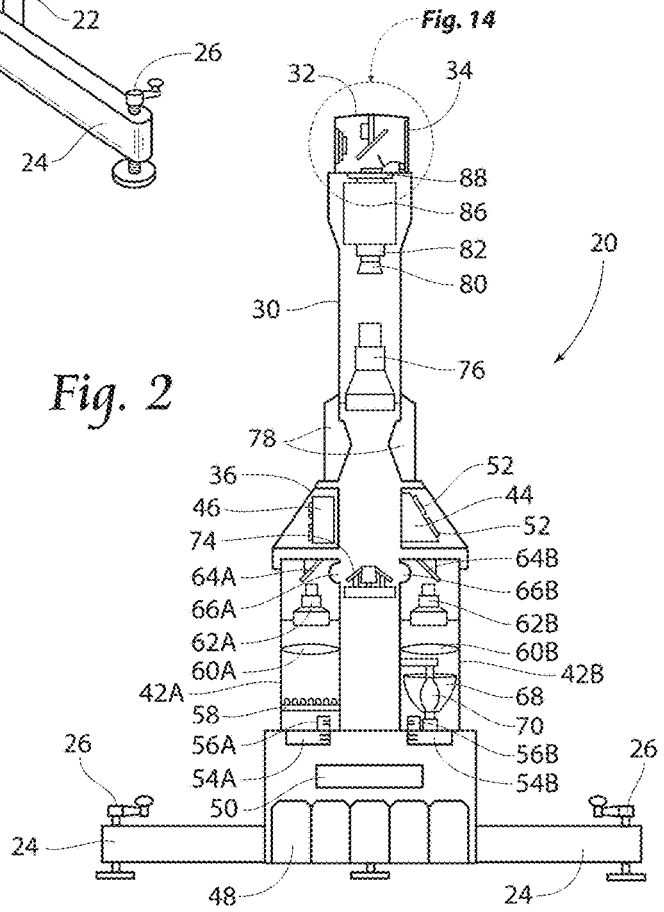
FIG. 2 is a side view, with portions cut away, of components of a DRI tower of the present invention.

Referring now to FIG. 2, a side view, with portions cut away, of components of tower 20 is shown. Skirt 36 houses transmitter recharging station 44 and storage space for master controller 46. Rechargeable power cells 48 are capable of providing enough electrical power to operate tower 20 for a limited duration without connection to an external electrical power source RF transceiver 50 not only receives signal from any active transmitters 52 set to its frequency, but is also used to communicate with other towers 20 within its range, for purposes of transmitter localization, and to coordinate multi-tower 20 operation. Transceiver 50 can be tuned to a range of general, or restricted frequencies. Four power supplies 54 regulate electrical power delivery to their respective light engines 42. Power supplies 54 may comprise ballasts, starters, microprocessors, voltage regulators, and other related components. In a preferred embodiment, light engines 42 are interchangeable among several variants, and can be preinstalled or exchanged on site by the operator to meet the requirements of the situation. For example, a light-emitting diode array offers an advantage of minimal power consumption, whereas extremely high-output illumination might require an incandescent, metal halide, or arc lamp combined with a reflector. Laser light, although potentially hazardous, may provide special purpose illumination, while infrared sources can be used for covert illumination. Any combination of these various types of light engines 42 can be installed, offering the operator a range of available types of illumination. The operator can then selectively activate one, two, three or all four light engines 42 to meet the needs of the situation. All light engines 42, regardless of specific internal configuration, are identical in external size and shape, in order to facilitate interchange. As exemplified here, light engine 42A comprises a light-emitting diode array, and light engine 42B comprises an arc lamp. Terminal dock 56A makes positive connection with contacts located on base 22 to convey data and electrical power from power supply 54A to and from light engine 42A. Light-emitting diode array 58 output is concentrated by collector 60A, and focused upon first stage lens 62A. The output of first stage lens 62A is focused upon front surface reflector 64A, and is thereby deflected at a 90° angle relative to the incoming light path. The illumination exits light engine 42A at port 66A, which is aligned with a similar opening into central column 30. Light engine 42B comprises parabolic reflector 68, and arc lamp 70, which receives power from power supply 54B via terminal dock 56B. Output illumination from arc lamp 70 is concentrated by collector 60B, and focused upon first stage lens 62B. Front surface reflector 64B deflects illumination from first stage lens 62B, directing it via port 66B into central column 30. Subsequently, outputs from all active light engines 42 are focused upon switcher assembly 72, mounted inside central column 30, and comprising four digital micromirror devices 74. Each micromirror device 74 is capable of alternating between two states, as directed by master controller 46: the open state deflects the light path from its respective light engine 42 into the second stage lens 76. The closed state deflects the light path into one of four dedicated light-absorptive heat sinks 78 attached to the inner wall of central column 30. Output from second stage lens 76 is focused directly into third stage lens 80, which is mounted upon the axis of rotation inside hollow bore driveshaft 82. In a preferred embodiment, third stage lens 80 is anamorphic, thereby outputting an oblong profile of illumination, focused upon main deflector 84. The rotation of this aspherical profile is thus coupled to the rotation of hollow bore driveshaft 82, causing the final output beam to assume a vertically columnar-profile, rather than a circular concentration of light. An alternate embodiment relies upon light shaping diffusion to narrow and elongate the illumination profile, eliminating third stage lens 80, in which instance, output from second stage lens 76 is calibrated to focus through the rotating light shaping diffusion directly upon main deflector 84. Motor 86 provides rotational force to rotary head 32 via hollow bore driveshaft 82. Electrical energy and data passes to and from rotary head 32 via rotary electrical joint 88. Preferably, motor 86 is capable of three different ranges of rotational rates, dependent upon the currently engaged mode of operation. In the "standard run" mode, tower 20 projects radial illumination, and the rotational rate of motor 86 is adjustable through a range of 800 rpm to 2400 rpm (approximate). The operator uses this variability to tune the output for best effect, as the situation demands. In the "loop record" mode, tower 20 records specific instructions from the operator in real time via master controller 46 or a computer. The rates of rotation in this mode range from 0.25 rpm to 10 rpm (approximate). In this instance, the variable rate of rotation permits the operator to slow the sweep of the beam, allowing precise adjustments to be made. In the "lock, and dwell" mode, motor 86 steps to preprogrammed points, and holds its position thereon for a preset duration.

Figure 3:
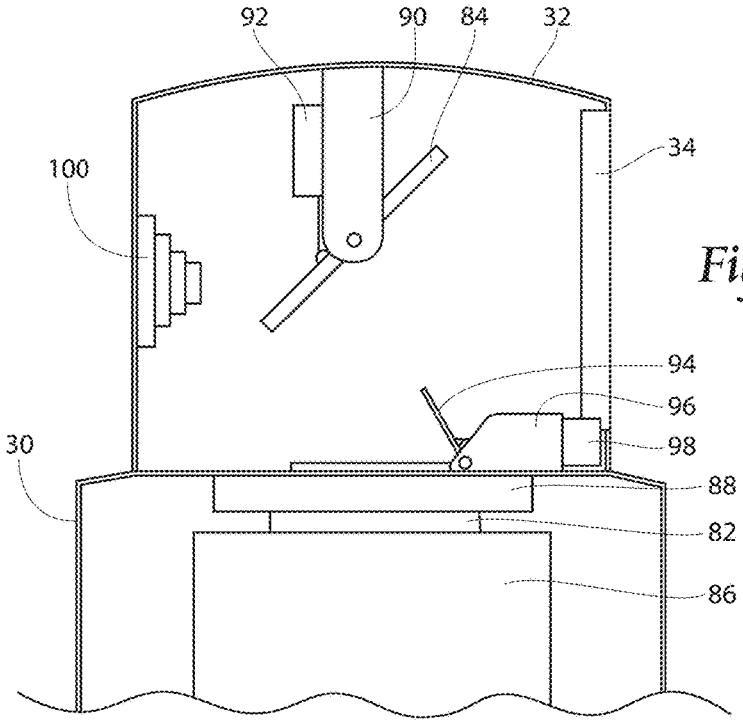
FIG. 3 is a close side view, with portions cut away, of the rotary head of a DRI tower of the present invention.

Referring now to FIG. 3, a close side view of rotary head 32, with portions cut away, of tower 20 is shown. Third stage lens 80 focuses its output onto main deflector 84. The light path is here deflected onto a horizontal plane. In a preferred embodiment, main deflector 84, a lightweight front-surface reflector, pivots upon tilt yoke 90, which also supports tilt micro-actuator 92. Tilt micro-actuator 92 adjusts the main deflector's 84 angle as directed by master controller 46, thereby altering the output light path's inclination and declination. Trim shutter 94 pivots upon trim yoke 96, which also supports trim microactuator 98. The cropping of the upper edge of the light path is executed by movement of trim shutter 94, as directed by master controller 46. This enables the vertical spread of the light output to be altered. Counterbalance 100 balances rotary head 32 and associated components upon the axis of rotation. The final output light path exits rotary head 32 through the optical glass of aperture 34.

Figure 4:
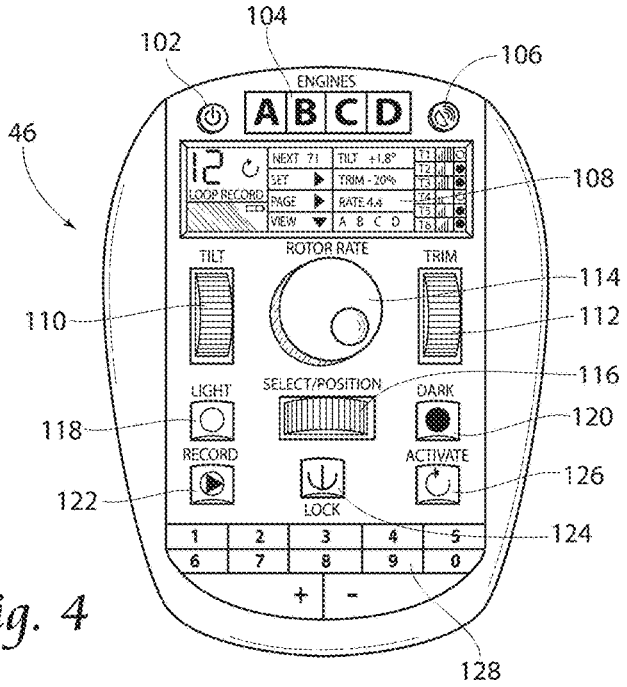
FIG. 4 is a perspective view of a DRI master controller associated with a DRI tower.

Referring now to FIG. 4, a perspective view of a preferred embodiment of master controller 46 associated with tower 20 is shown. Master controller 46 is stored inside skirt 36 when not in use, and can be either wireless or hardwired to tower 20. A single master controller 46 can interface with any number of towers 20 via discrete addressing. Main power button 102 is pressed to turn both tower 20 and master controller 46 on or off. Four light engine switches 104 select individual light engines 42 for programming. Transceiver settings button 106 displays tower's 20 operating RF frequency and other related settings. Main display screen 108 displays program numbers, light engine modes, status of transmitters, main power cell charge, and all other information such as diagnostics, global settings and calibration screens. Tilt thumbwheel encoder 110 controls tilt micro-actuator 92, and thus the angle of main deflector 84, thereby allowing vertical angling of the light beam during loop recording. Trim thumbwheel encoder 112 controls the behavior of trim micro-actuator 98 and pivoting trim shutter 94, allowing the vertical dimension of the beam's profile to be changed during loop recording. Rotor rate encoder 114 controls the rotational rate of motor 86. The ranges of this control are determined by the mode that tower 20 is currently executing: standard run, or loop record. Select/position thumbwheel encoder 116 is a dual function control. Its default mode selects menu items in main display screen 108. Secondarily, when recording in lock, and dwell mode, it acts as a manual radial positioning control of the light beam. Light key 118 is pressed and held during loop recording to record an open illuminator state, and dark key 120 is pressed and held to record a closed state. Record key 122 is pressed to enter loop record mode, then pressed again to save working memory data as a preset. It is also used to record as a preset all current hold patterns that have been set up with transmitters 52. Lock key 124 is pressed and held to enter lock and dwell mode, and pressed to set lock points at the radials selected with select position thumbwheel encoder 116. (A dwell time is programmable for each lock point.) Pressed and held again to record lock point and dwell time data as a preset, and exits lock and dwell mode. Activate key 126 is pressed to activate the current preset, and pressed again to deactivate it. Preset selection keypad 128 is used to input numerical and typographical information, and to select presets by number.

Master controller 46, or a generic computer running dedicated software, provides the digital processing and control of the entire system. All system functions are accessed through master controller 46, or a generic computer; some additional functions include:

- Beam spread at range: Sets the default horizontal spread of the beam at any given transmitter 52 range. This is an adjustment to the duration of the open or close cycle per revolution. For example, if the target is a person, the duration will be minimal, whereas if the target is larger, such as a vehicle, the duration can be extended.
- Beam alignment on target: The target of transmitter 52 and the beam can be set to diverge in various ways. For example, the beam of light (or dark) can be set to align two degrees to the left of the target.
- Address/slave/master: Configures which tower 20 issues commands, which towers 20 slave, and enables programming specific towers 20 from one master controller 46 by discrete addressing.
- Priority: Determines which transmitters 52 take precedence of command or override, and how tower 20 resolves conflicts of transmitter 52 against preset program.
- Synchronicity: To minimize or maximize strobe effects, multiple towers 20 can be set to rotate in variable phase relationships with one another.
- Invert: A function that switches light to dark and vice-versa, could be useful in both programming and operation.

Figure 5:
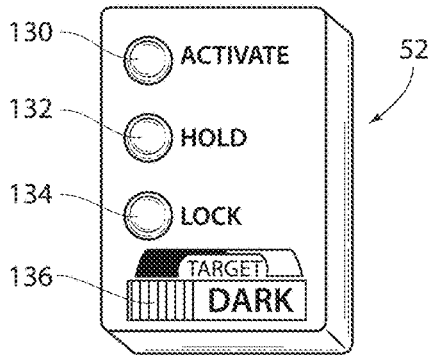
FIG. 5 is a perspective front view of a transmitter associated with a DRI tower.

Referring now to FIG. 5, a perspective front view of transmitter 52 associated with tower 20 is shown. Activate button 130 functions identically to the master controller's activate key 126. Pressed to activate a current preset or working memory; pressed again to deactivate it. Hold button 132 is pressed and held to signal all towers 20 on the same frequency and within its range to record transmitter's 52 movements. This will result in either area illumination or area obscuration, depending upon transmitter's 52 target setting, and will be maintained independent of subsequent transmitter 52 motion. Lock button 134 is similar in function to the master controller's lock, key 124. Pressed to set a lock point with infinite dwell time at transmitter's 52 current bearing and vertical angle from all towers 20 sharing its frequency and within its range. Pressing it again results in the setting of a new lock point, deleting the previous one. Pressed and held to delete all active locks or holds, and resume normal (standard running speed) operation. Target selection switch 136 determines whether transmitter 52 is tracked in an open (light) or closed (dark) state, resulting in either a follow spot effect, or negative illumination. This also determines whether the hold function is tracked in an open or closed state.

Figure 6:
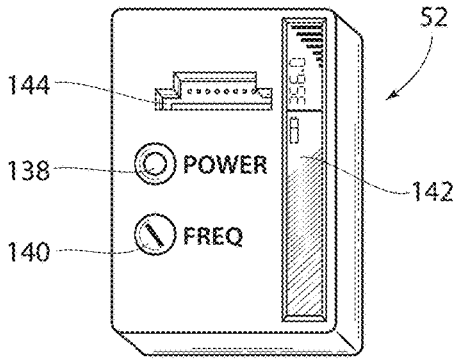
FIG. 6 is a perspective rear view of a transmitter associated with a DRI tower.

Referring now to FIG. 6, a perspective rear-view of transmitter 52 associated with tower 20 is shown. Power button 138 turns the transmitter on and off. Frequency selector 140 is used to select transmitter's 52 operating frequency. Display screen 142 shows transmitter's 52 remaining power cell charge, currently selected frequency, and the current RF signal strength. Recharge hub 144 couples with transmitter recharging station jack 146 to facilitate the storage and recharging of unused transmitters 52.

Figure 7:
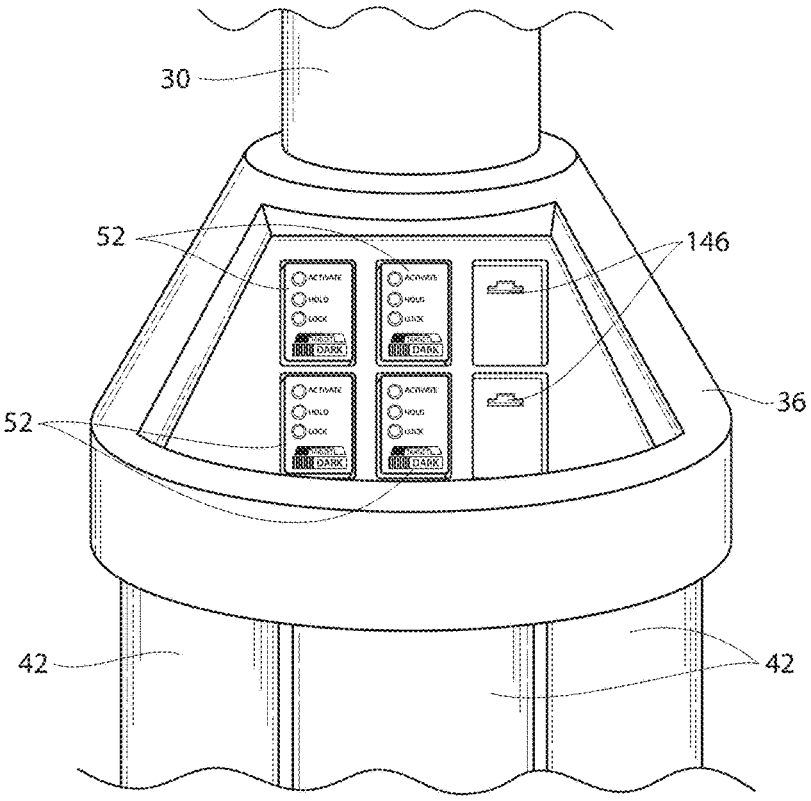
FIG. 7 is a perspective view of the transmitter recharging station internal to a DRI tower, holding multiple docked transmitters.

Referring now to FIG. 7, a perspective; view of transmitter recharging station 44 with multiple docked transmitters 52 within tower 20 is shown. Transmitter station access panel 38 has been removed to expose transmitter recharging station 44, which provides constant direct current to multiple jacks 146, allowing the recharging and storage of transmitters 52 when not in use. The individual charge status of each transmitter 52 is displayed here, and can be monitored at master controller 46 or a computer. Four transmitters 52 are shown docked and recharging, and two jacks 146 are shown without, connected transmitters 52.

Operational Examples of the Invention

A DRI is able to produce a variety of optical effects, many of which can be combined to produce behavior of greater complexity. Some effects include:

- Full 360 degree perimeter illumination
- Multiple static sector illumination or obscuration
- Multiple static point illumination or obscuration
- Multiple active tracking illumination (follow spot effect)
- Multiple active tracking obscuration (negative illumination)
- Dazzling and impairment of designated personnel and optical equipment
- Local optical tagging and tracking of designated targets
- Covert tagging, tracking, and illumination (infrared)
- Selective illumination of an area with minimal impact upon designated personnel's night vision.

Figure 8:
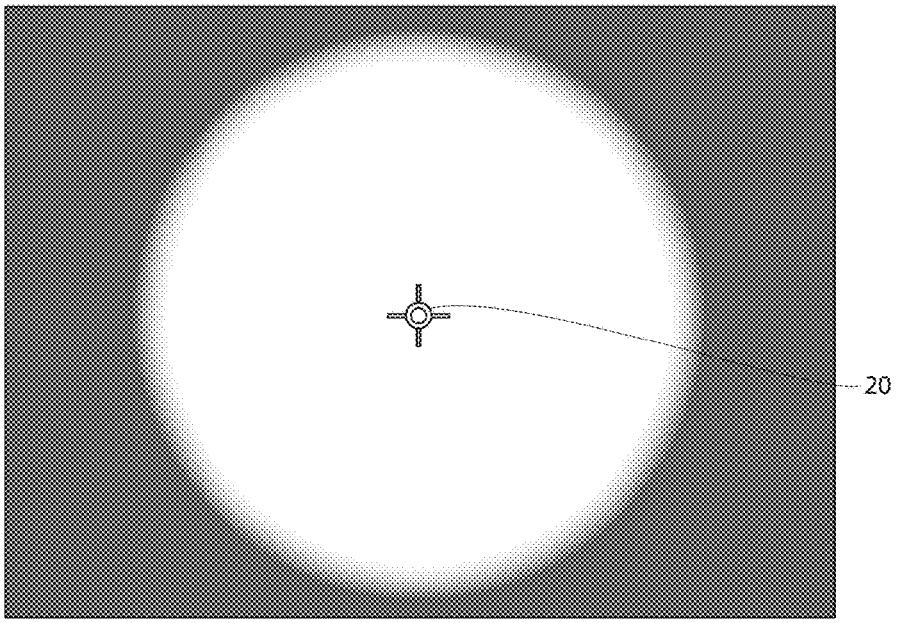
FIG. 8 is an aerial view of a single operational DRI tower providing a full 360 degrees of illumination.

A DRI can generate the long distance illumination of a spotlight combined with the area coverage of a floodlight. Referring specifically to FIG. 8, an aerial view of a single tower 20 providing night perimeter illumination is shown, although this operational configuration can be used for other purposes. A flat 360 degree perimeter sweep of this type is the default running mode of tower 20, and therefore would simply need to be activated, and the rotational rate adjusted for best results. We will briefly review how it might be programmed onsite, using master controller 46 or a computer. In a preferred embodiment, the operator would first select a preset slot to record into; in this example, we will use preset 10. The operator presses record key 122, causing the illumination to open, and motor 86 to begin rotating in loop record mode (0.25 rpm to 10 rpm). After the beam has made at least one full rotation, record key 122 is pressed again, thus saving the data as preset 10. Now, this preset may be activated and deactivated by pressing activate key 126 at master controller 46, or via transmitter 52. Alternatively, a flat perimeter sweep could be programmed by transmitter 52 signal. Walking transmitter 52 through one full orbit around tower 20 while keeping hold button 132 depressed will cause tower 20 to remain in a continuously open state. (Assuming that transmitter 52 is set to target: light). This data will remain as a "working memory" which, unless it is saved as a preset, will be deleted when a new preset is called up, or when tower 20 is turned off.

Figure 9:
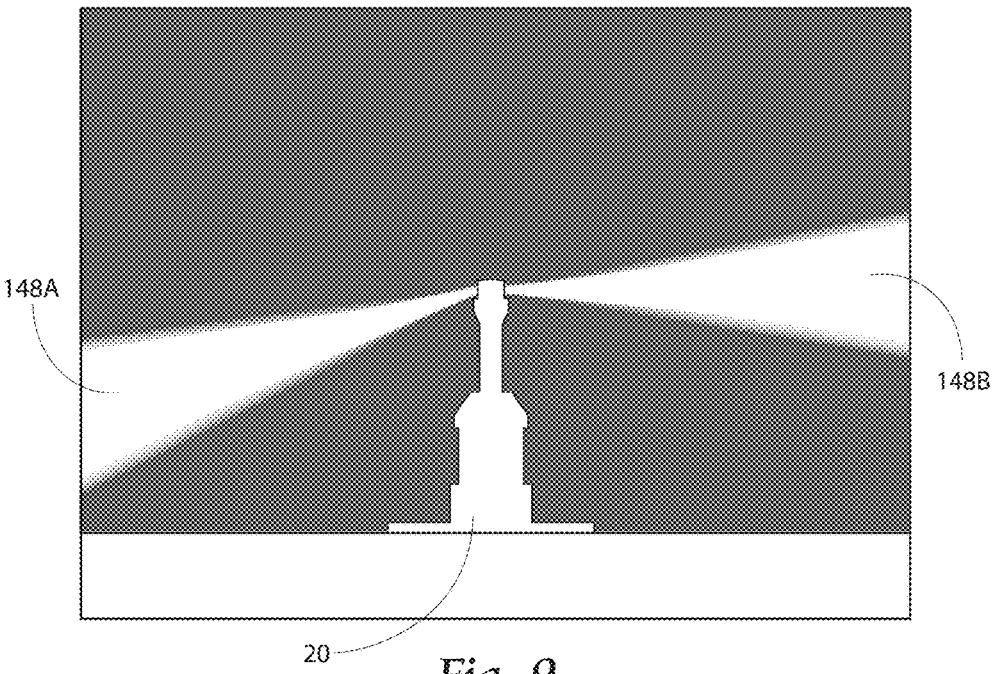
FIG. 9 is a side view of an operational DRI tower generating two separate beams of differing vertical trim and vertical angle.

Referring now to FIG. 9, a side view of tower 20 in operation is shown. The rotating beam of light is only open at radials 148A and 148B. These two different light paths have been set to diverge from horizontal using the tilt thumbwheel encoder 110, and each has been cropped vertically by use of the trim thumbwheel encoder 112.

Figure 10:
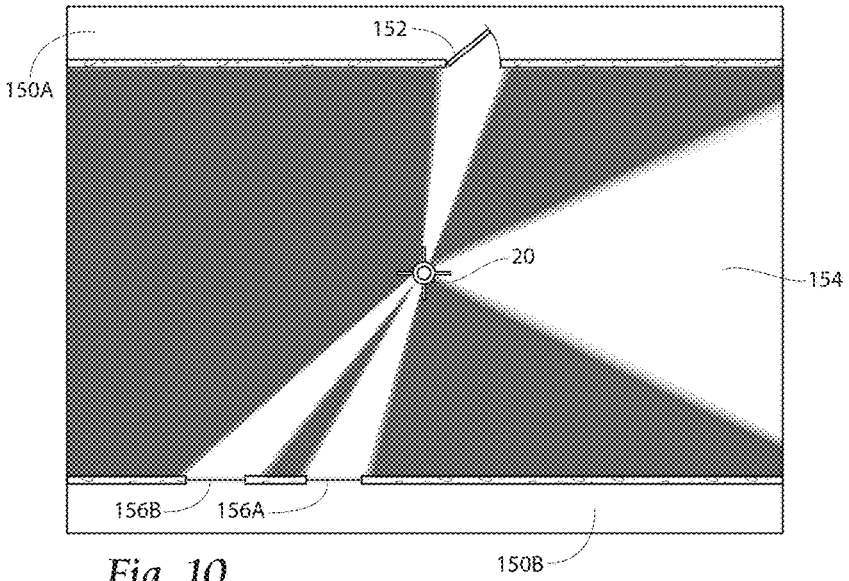
FIGS. 10-12 are aerial views of illumination and negative illumination scenarios that can be provided by the DRI tower(s) in association with one or more transmitters.
Figure 11:
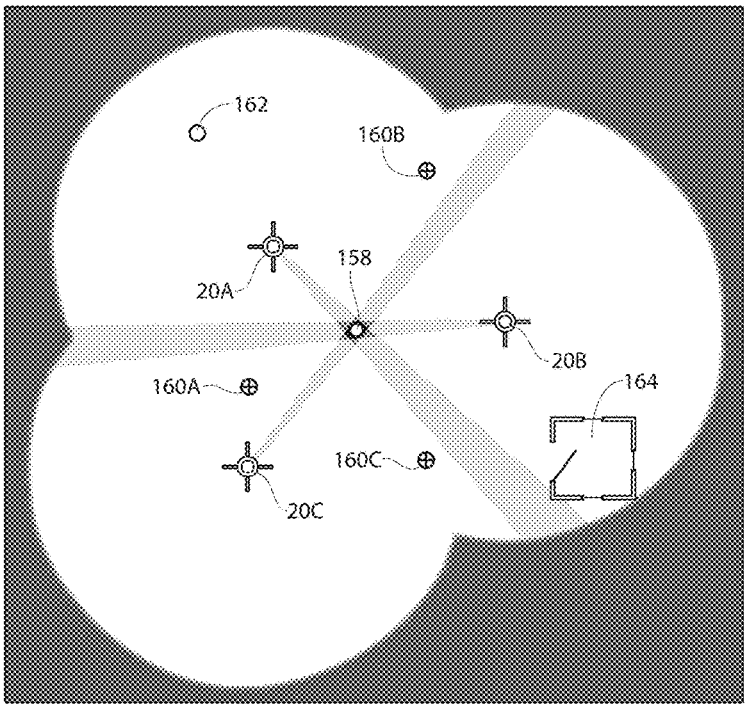
Figure 12:
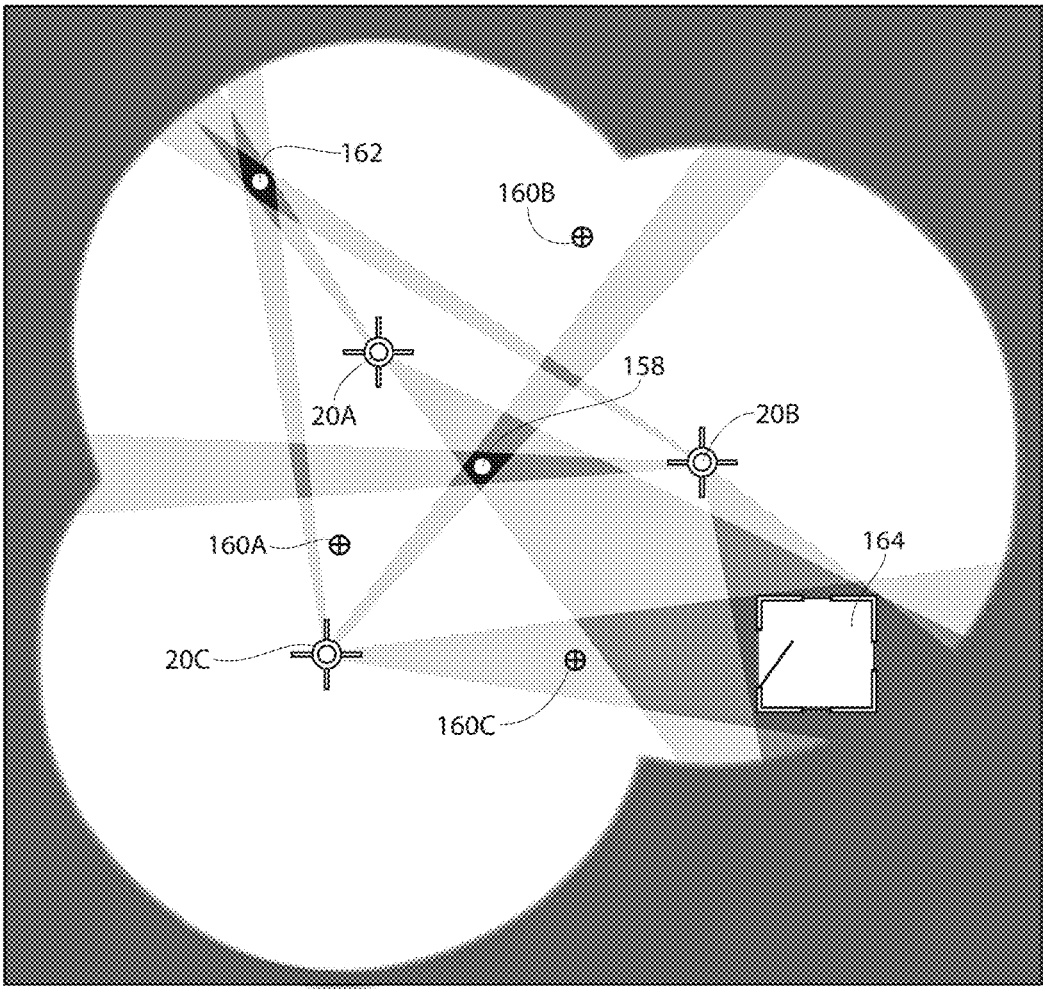

FIGS. 10-12 are aerial views of illumination and obscuration scenarios that can be provided by the DRI system using a combination of preset programs and active transmitter 52 tracking and control. While the first of these examples depicts the effect, generated by a single tower 20, in the preferred embodiment, three towers 20 is an ideal effective minimal deployment.

Referring specifically to FIG. 10, an aerial view of a single tower 20 positioned in a street between buildings 150A and 150B is shown. Tower 20 is illuminating only the targeted areas, namely, doorway 152 of building 150A, street approach 154 from the east, and windows 156A and 156B of building 150B. This type of selective illumination can offer several tactical advantages over general floodlighting: included observers located in the dark areas are obscured, and can preserve their night vision, while their areas of concern are visually highlighted by precision lighting. Excluded observers located in the light areas are rendered conspicuously visible, and are subject to the effects of a blinding and disorientating spotlight locked on their positions.

Let's analyze how this scenario was programmed after tower 20 had been set in place. In the preferred embodiment, the operator, using a computer or master controller 46, first selects a preset slot in which to record. The operator then presses record key 122, which causes the tower 20 to enter loop record, mode—the illumination opens and motor 86 begins slowly rotating. The operator allows the beam of light to sweep past doorway 152, across eastern street approach 154, and then uses tilt thumbwheel encoder 110 to angle the beam of light up to second story windows 156A and 156B. After the beam has transited across windows 156A and 156B, the operator uses tilt thumbwheel encoder 110 to return the beam to a horizontal plane. Now, all subsequent rotations of the beam will follow these vertical movement, instructions, unless a change is made. Now the operator uses trim thumbwheel encoder 112 to crop the upper edge of the light, beam so that it matches the vertical dimension of the various targets: doorway 152, street approach 154, and windows 156A and 156B. Finally, the operator uses light key 118 and dark key 120 to close the illumination except, during the beam's transit across the four targets. The operator may use rotor rate encoder 114 to slow the beam further for the fine-tuning of the program. Any errors made during loop recording can be overwritten during subsequent revolutions of the beam. When the operator is satisfied with the program, he again presses record key 122 to save it as a preset. Pressing activate key 126, or transmitter's activate button 130, will now execute this preset.

Although the above example has direct tactical relevance, it could also pertain to architectural lighting; providing, for example, illumination of selected architectural features while simultaneously preventing light spill onto doorways and windows. This type of architectural lighting could be instantly converted to other purposes, simply by changing presets. It could also be responsive to motion sensors, or to select personnel, such as residents, security personnel, or law enforcement officers.

Lighting of commercial advertising, such as banners and billboards could also be derived from this example, for the various presets and sequences of presets could give dynamic lighting to otherwise static imagery. This type of lighting may not be subject to legal restriction in the same way that full-motion video billboards are in many areas.

A DRI's differential illumination is applicable also to theatrical and concert production, enabling the lighting director to conceal and reveal set changes or selective areas of a stage, as well as offering strobe, wash, and spotlight functions. Potential benefits to stage magic and illusion production are evident. Referring now to FIG. 11, an aerial view of an operating deployment of three towers 20A, 20B, and 20C is shown. Areas without shading receive illumination from all three; towers 20. Lightly shaded areas receive illumination from two towers 20, and blacked out areas receive no illumination. The relative positioning of towers 20A, 20B, and 20C is subject to the circumstances of deployment, the desired effects, and environmental factors. For instance, multiple towers 20 could be deployed in a linear arrangement, with excluded observers on one side, and included, observers on the other. The arrangement shown is arbitrary; used here to illustrate the active tracking of transmitter 52. In the preferred embodiment, no programming is required, to configure this scenario, as towers 20A, 20B, and 20C are all in their default perimeter sweep mode. Operative X 158 need only take transmitter 52 from transmitter recharging station 44, turn it on, verify that its RF frequency matches towers' 20A, 20B, and 20C frequencies, set transmitter's 52 targeting to dark, and press activate button 130. Operative X 158 is now free to move about the illuminated area, remaining always within a "box of shadow." This will provide operative X 158 with complete illumination of the surroundings, without risk of being blinded by towers 20A, 20B, and 20C, for they are always in a closed state as they sweep across operative X's 158 location. Excluded observers 160A, 160B, and 160C are rendered conspicuously visible, and are subject to the impairment and disorientation caused by three high intensity spotlights aimed at them. The differential illumination produced in this scenario, enhanced by site preparation and good technique, can result in operative X 158 being rendered invisible to excluded observers 160A, 160B, and 160C. Located also in the illuminated areas are excluded operative Y 162, and guard post 164.

Referring now to FIG. 12, the previous deployment of three towers 20A, 20B, and 20C is again shown. Areas with no shading receive illumination from three towers 20. Lightly shaded areas receive illumination from two towers 20, and darker areas receive illumination from one tower 20. Blacked out areas receive no illumination. The towers 20 continue to track and negatively illuminate operative X 158, and now negatively illuminate transmitter 52 protected operative Y 162, while simultaneously obscuring guard post 164 via preset program. This demonstrates how multiple towers 20A, 20B, and 20C can track multiple moving transmitters 52, while simultaneously executing preset programs. Excluded observers 160A and 160B are exposed to direct illumination from towers 20A, 20B, and 20C. Excluded observer 160C, located in a partially shadowed region, is still illuminated by towers 20A and 20B.

The further versatility of the DRI is demonstrated by contemplating some of its other possible configurations. Several DRIs could be part of a permanent installation, in which case, it would be advantageous to integrate them with the infrastructure. For example, consider an indoor operation with elevated security measures, such as a checkpoint. The DRIs have been connected with the building's interior lighting systems, but now remain unobtrusive, operating in standby status. The personnel manning this checkpoint wear transmitters 52, powered on, and set to target: dark. If a threatening situation arises, any of the personnel may choose to activate his transmitter 52, bringing all DRIs out of standby while simultaneously cutting the building's normal lighting. This would instantly fill the space with brilliant eye-level illumination, exempting only the checkpoint personnel who, protected by their transmitters 52, remain obscured, and are so offered an immediate advantage in dealing with the situation.

The DRI can be adapted to fit emergency response vehicles. Consider one scenario, in which several police vehicles are responding to a "shots fired" situation. Even as the officers arrive on scene, their vehicle rooftop DRIs could be active, providing full perimeter illumination. If the situation merits it, one officer could remain in his vehicle to program all of the DRIs on site, via discrete addressing. When the officers do exit their vehicles, they carry frequency-matched transmitters 52, insuring that they will always remain obscured, and will never be impaired by their own lighting. By pressing transmitter lock button 134, an officer could choose to 'mark' a detained suspect, suspicious object, or specific location with the concentrated non-rotational output of some or all DRI units present.

Consider another scenario: the roadside traffic stop—a routine, yet potentially dangerous situation. Here, a preset program that illuminates ahead, and the entire right side of the suspect vehicle would be ideal. This would provide illumination of the vehicle, as well as the entire field of view on the passenger's side. This program would offer the broadest possible field of illumination, while leaving traffic approaching from either direction unimpaired by bright spotlights. Note that in the above situations, and many others of a tactical nature, personnel can be substantially relieved of the distraction of handling and aiming their own hand-held or weapon-mounted illuminators.

Several incidental effects should be noted:

The four light engine 42 configuration allows the option of lighting sectors with differing illumination. For instance, half a field could be illuminated by arc light, one quarter by infrared light-emitting diode, and one quarter by green light. Transmitters 52 could also be tracked using any single or combination of multiple light engines 42.

If transmitters 52 have a significant range, then tower 20 could be used as a visual beacon by anyone carrying such a transmitter 52. Conversely, tower 20 could be used as a visual indicator of the bearings of active transmitters 52.

Due to the horizontal and radial nature of the light beam, it could be utilized as a sort of emergency aviation beacon, capable of indicating compass directions and other basic information visually.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

I claim:

1. A radial illuminator comprising:

a light source configured to illuminate one or more fixed areas by rotatably emitting light at a rate to give an appearance that the one or more fixed areas are continuously and simultaneously illuminated; and a control operatively coupled to said light source and configured to control operation of said light source, wherein said control is programmable to illuminate the one or more fixed areas excluding one or more selected locations, wherein the one or more selected locations are located within the one or more fixed areas.

2. The radial illuminator of claim 1, said illuminator configured to communicate with one or more locating devices for determining one or more locations of said locating devices relative to said control.

3. The radial illuminator of claim 1, wherein said control is programmable to limit illumination by said light source to only the one or more selected locations.

4. The radial illuminator of claim 1 further configured to receive one or more of the following commands: a record command, a lock command, an activate command, a tilt command, a trim command, a rotor rate command, and an illumination command.

5. The radial illuminator of claim 1, wherein said rotation rate is at least approximately 800 revolutions per minute.

6. The radial illuminator of claim 1, further comprising a rotatable reflector with an axis of rotation substantially parallel to light received from said light source.

7. The radial illuminator of claim 6, further comprising a reflector actuator to alter the angle of said rotatable reflector in relation to said axis of rotation.

8. The radial illuminator of claim 6, further comprising a deflector between said light source and said rotatable reflector to adjust the amount of light emitted.

9. A radial illuminator, comprising:

a housing;

one or more light sources on said housing;

a rotatable reflector on said housing configured to deflect light emitted from said one or more light sources;

a power source configured to rotate said rotatable reflector at least approximately 800 revolutions per minute around an axis of rotation such that one or more areas appear continuously illuminated; and a control configured to confine illumination by said one or more light sources such that one or more selected locations within the one or more areas are excluded from illumination.

10. The radial illuminator of claim 9, further comprising a reflector actuator to alter the angle of said rotatable reflector in relation to said axis of rotation.

11. The radial illuminator of claim 9, further comprising a shutter between said one or more light sources and said rotatable reflector to adjust the amount of light emitted.

12. The radial illuminator of claim 9, wherein said one or more light sources comprises two or more light sources, wherein a first of said light sources is configured to send instructions of operation to a second of said sources.

13. The radial illuminator of claim 9, further configured to communicate with at least one locating device for determining said one or more locations.

14. The radial illuminator of claim 13, further configured to select and continuously update said one or more locations based upon the position of the locating device in real time.

15. The radial illuminator of claim 9, wherein said control is configured to communicate with at least one locating device such that the position of said at least one locating device remains illuminated.

16. A light system, comprising:

a plurality of radial illuminators, each of said radial illuminators comprising:

one or more light sources configured to rotatably emit light and illuminate one or more areas, the emission configured to rotate at a rate at least approximately 800 rotations per minute to give an appearance that the one or more areas are continuously illuminated; and a control configured to confine illumination by said one or more light sources such that one or more selected locations within the one or more areas are excluded from illumination;

wherein one of said plurality of radial illuminators is configured to send instructions of operation to said controls, wherein said controls are configured to receive said instructions; and wherein each of said radial illuminators is configured to be positioned at a unique position such that the one or more selected locations are at unique angles in relation to each of said radial illuminators.

17. The light system of claim 16, wherein each of said plurality of radial illuminators are configured to illuminate the same one or more selected locations.

18. The light system of claim 16, wherein said one or more selected locations are determined by a locating device.

* * * * *